US007677003B2

(12) United States Patent
Baughn et al.

(10) Patent No.: US 7,677,003 B2
(45) Date of Patent: Mar. 16, 2010

(54) INTEGRATED STORM SHUTTER INCLUDING LATCH PIN CORNER CONNECTION AND/OR CENTER LOUVER SUPPORT RAIL

(76) Inventors: Antony L. Baughn, 802 Corto, Pensacola Beach, FL (US) 32561; Timothy S. Baughn, 1343 Bay Shore Ter., Gulf Breeze, FL (US) 32563; Douglas Oakey, 3371 Crestview La., Gulf Breeze, FL (US) 32563

( * ) Notice: Subject to any disclaimer, the term of this patent is extended or adjusted under 35 U.S.C. 154(b) by 1180 days.

(21) Appl. No.: 10/796,969

(22) Filed: Mar. 11, 2004
(Under 37 CFR 1.47)

(65) Prior Publication Data

US 2005/0210777 A1 Sep. 29, 2005

(51) Int. Cl.
*E04B 7/08* (2006.01)
*E04C 2/38* (2006.01)

(52) U.S. Cl. ..... 52/473; 52/656.9; 52/667

(58) Field of Classification Search ..... 52/204.61, 52/473, 656.9, 663, 667, 656.7, 656.8
See application file for complete search history.

(56) References Cited

U.S. PATENT DOCUMENTS

| | | | | | |
|---|---|---|---|---|---|
| 1,380,980 | A | * | 6/1921 | Lane | 454/224 |
| 2,587,440 | A | | 2/1952 | Burkhart | |
| 2,835,935 | A | | 5/1958 | Housley | |
| 2,840,870 | A | * | 7/1958 | Pohlman | 52/473 |
| 3,022,549 | A | | 2/1962 | Cummings | |
| 3,077,643 | A | | 2/1963 | Horner | |
| 3,394,518 | A | * | 7/1968 | Worrell, Jr | 52/473 |
| 3,429,070 | A | * | 2/1969 | Hurst | 49/158 |
| 3,455,079 | A | * | 7/1969 | Frederick | 52/473 |
| 3,461,629 | A | * | 8/1969 | Smith | 52/314 |
| 3,550,342 | A | * | 12/1970 | South | 52/509 |
| 3,638,383 | A | * | 2/1972 | Escudero Ribas | 52/473 |
| 3,797,186 | A | * | 3/1974 | Smith | 52/314 |
| 3,968,738 | A | * | 7/1976 | Matzke | 454/309 |
| 4,726,149 | A | | 2/1988 | Tryba | |
| 4,831,804 | A | * | 5/1989 | Sayer | 52/475.1 |
| 4,937,979 | A | * | 7/1990 | Liou | 49/449 |
| 4,939,880 | A | * | 7/1990 | Wang | 52/473 |
| 5,163,260 | A | * | 11/1992 | Ricard et al. | 52/473 |
| 5,255,486 | A | * | 10/1993 | Wang | 52/473 |
| 5,316,065 | A | | 5/1994 | Alligood | |
| 5,383,315 | A | | 1/1995 | Birs | |
| 5,431,211 | A | * | 7/1995 | Guillemet | 160/381 |
| 5,450,701 | A | * | 9/1995 | White | 52/656.9 |
| 5,465,537 | A | | 11/1995 | Fullwood | |
| 5,509,239 | A | | 4/1996 | Fullwood | |
| 5,524,407 | A | * | 6/1996 | Ricard et al. | 52/473 |
| 5,549,148 | A | * | 8/1996 | Figueiredo et al. | 160/183 |
| 5,620,037 | A | | 4/1997 | Apostolo | |
| 5,634,998 | A | * | 6/1997 | Schiedegger et al. | 156/73.1 |

(Continued)

*Primary Examiner*—Michael Safavi
(74) *Attorney, Agent, or Firm*—Michele V. Frank; Patton Boggs LLP

(57) ABSTRACT

A shutter having a unitary frame formed by four perimeter rails, each having a receptacle at each of its distal ends, with four connection members, each having structure inserted into and secured within one receptacle of each of two of the perimeter rails. Optionally, a latch pin is movable through a guide hole formed in one of the corner connection members. A further option is louvers extending through a center support.

33 Claims, 10 Drawing Sheets

U.S. PATENT DOCUMENTS 5,651,221 A 7/1997 Golen
5,737,874 A * 4/1998 Sipos et al. ..... 49/67
5,778,598 A * 7/1998 Ohanesian ..... 49/74.1
5,852,903 A 12/1998 Astrizky
5,857,298 A 1/1999 Fullwood
5,907,929 A 6/1999 Poma et al.
5,911,660 A 6/1999 Watson
5,957,186 A 9/1999 Boswell
5,983,971 A 11/1999 Miller et al.
6,189,264 B1 2/2001 DiVeroli
6,205,713 B1 3/2001 Thompson et al.
6,219,985 B1 * 4/2001 Hsu ..... 52/473
6,263,632 B1 * 7/2001 Cadorette ..... 52/473
6,345,476 B1 * 2/2002 Hill ..... 52/202
6,536,174 B2 * 3/2003 Foster et al. ..... 52/473
6,543,188 B1 4/2003 Poma et al.
6,817,141 B2 * 11/2004 Chen ..... 49/87.1
6,845,593 B2 * 1/2005 Silverman ..... 52/655.1
6,877,285 B2 * 4/2005 Poma et al. ..... 52/202
6,996,934 B2 * 2/2006 Briscoe et al. ..... 49/67
7,131,241 B2 * 11/2006 Blackwell et al. ..... 52/473
2002/0056230 A1 * 5/2002 Horn et al. ..... 49/74.1
2004/0003540 A1 * 1/2004 Horn et al. ..... 49/74.1
2004/0035082 A1 * 2/2004 Hudoba et al. ..... 52/656.7
2006/0162266 A1 * 7/2006 Hay, III ..... 52/202
2006/0248822 A1 * 11/2006 Ho ..... 52/204.2
2007/0094954 A1 * 5/2007 Blackwell et al. ..... 52/204.1

* cited by examiner

FIG. 15
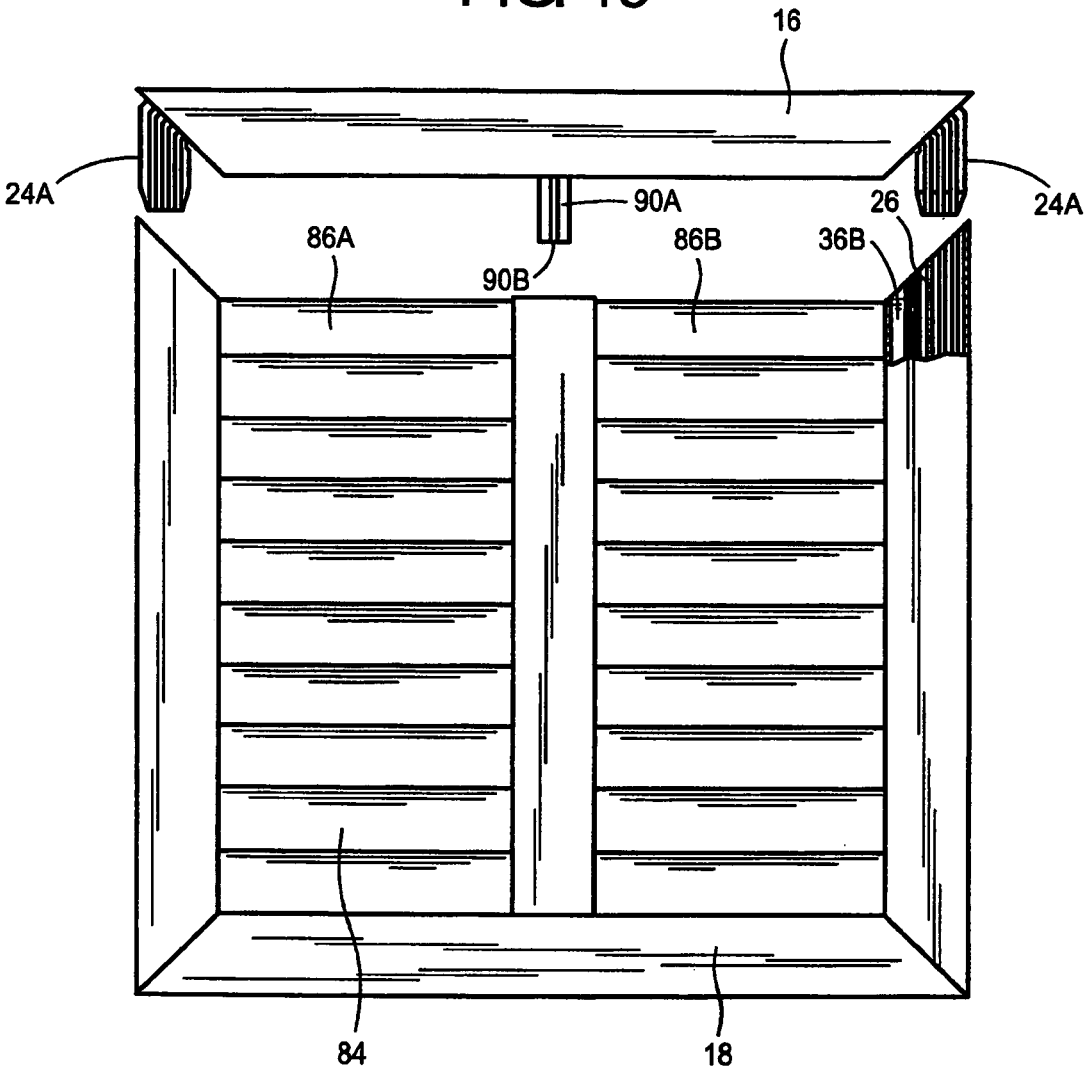
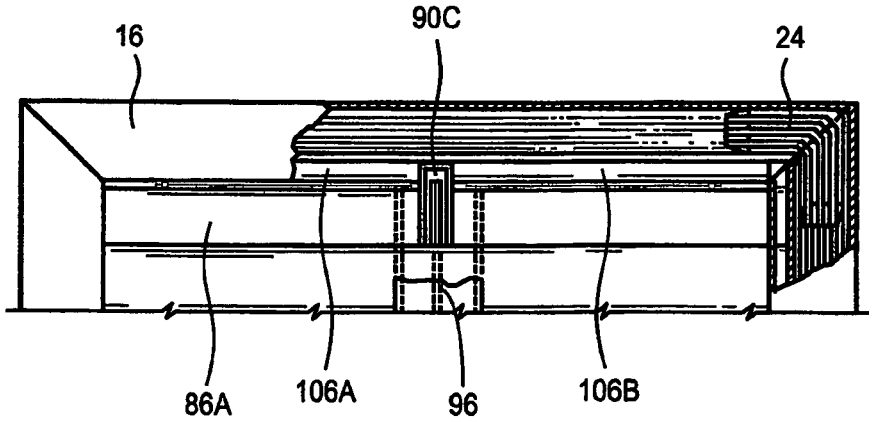
FIG. 16

INTEGRATED STORM SHUTTER INCLUDING LATCH PIN CORNER CONNECTION AND/OR CENTER LOUVER SUPPORT RAIL

BACKGROUND OF THE INVENTION

This invention relates generally to window and other building portal protection and, more specifically, to methods and apparatus for protecting windows and other building portals against wind, airborne moving objects, and other conditions likely to cause damage to the portal structure or, upon entry, to an interior of the building.

A variety of structures for shutters, for houses, apartments, motels, hotels and other commercial buildings are known in the building arts. Shutters may be, but are typically not installed for permanent or semi-permanent coverage over their associated portal. More typically, shutters are selectively movable and securable into open and shut modes using, for example, a hinge and latch mechanism.

Examples of known shutter types include rolling shutters, accordion shutters, removable and stowable panels, "Bahama" shutters, and "Colonial" shutters.

Rolling shutters, or roll shutters, include a plurality of parallel abutting slats, hinged to one another or attached at their respective ends to flexible support strips. A coiling mechanism selectively winds the slats into a bundle above the window, and unwinds them such that they collectively cover the window. Rolling shutters offer substantial protection but have shortcomings, such as blocking the view and the airflow through the portal when they are closed, that makes them undesirable for many applications.

Accordion shutters generally comprise an assembly of hinged, interlocking aluminum or steel blades that move horizontally between an upper and lower track. The blades are substantially abutting and parallel to one another when the assembly is extended across the window, and fold into a stack, accordion-style, when the assembly is moved to its open position. For larger areas there are two blade assemblies, that meet in the middle of the window portal when closed, and which moves toward the right and left, respectively, to assume an open position.

Removable and stowable panels are typically a low-cost, effective protection. Variations include plywood that is nailed or bolted to the building exterior, and corrugated metal covers that fit into tracks that are permanently installed above and beneath the windows. Although simple and relatively low cost, these typically require considerable manual effort to install and remove, and require substantial, accessible storage space.

"Bahama" and "Colonial" style shutters are respective styles of louvered shutter assemblies that are hinged to swing open and shut over a window or other portal. The Bahama style is a single panel shutter, the panel having a slightly larger area than that of its associated window. The top of the shutter is attached to a hinge mechanism having a pivot axis above the window opening. The shutter is supported in its open position by two removable struts, at an angle of approximately 45 degrees. The shutter is closed to serve as a window protection by removing the two rods, allowing the shutter to lie flat against the building and over the window. A sliding pin then locks it. The Colonial style is a two-panel shutter, each panel attached to a hinge extending vertically at either side of the window. The shutters are moved to their open position by swinging each outward until it lies flat against the building, one at each side of the window. The shutters are closed by folding each inward until each is flat over its half of the window. A latch holds the shutter panels in their closed position.

The outer frame of the Bahama shutters, and of each of the two halves of the Colonial shutter, is typically formed of four abutting members, screwed or welded together at the respective ends. U.S. Pat. No. 5,907,929, at FIGS. 2 and 6, depicts an example of a screwed-together abutting end.

The present inventors have identified that although the known types and examples of shutters may provide certain forms of protection for windows and portals, a need exists for reduced weight, increased strength, extended life, and ease of installation and operation.

For example, the screw connection of the rails of the Bahama shutters depicted by U.S. Pat. No. 5,907,929 may fail due to environmental conditions such as, for example, repeated wind-induced flexing of the shutter and its peripheral rails. Similarly, welded butt joints at the corners of the shutter frame have a probability of failing, due to repeated flexing of the joints or to defects in the original weld quality.

BRIEF DESCRIPTION OF THE DRAWINGS

FIG. 15 shows the shutter of FIG. 11 with its upper perimeter rail suspended above its assembly position;

FIG. 16 is a partial cut-away of the top perimeter rail member, in its assembled position;

DETAILED DESCRIPTION OF THE PREFERRED EMBODIMENTS

The Overview

Figure 1:
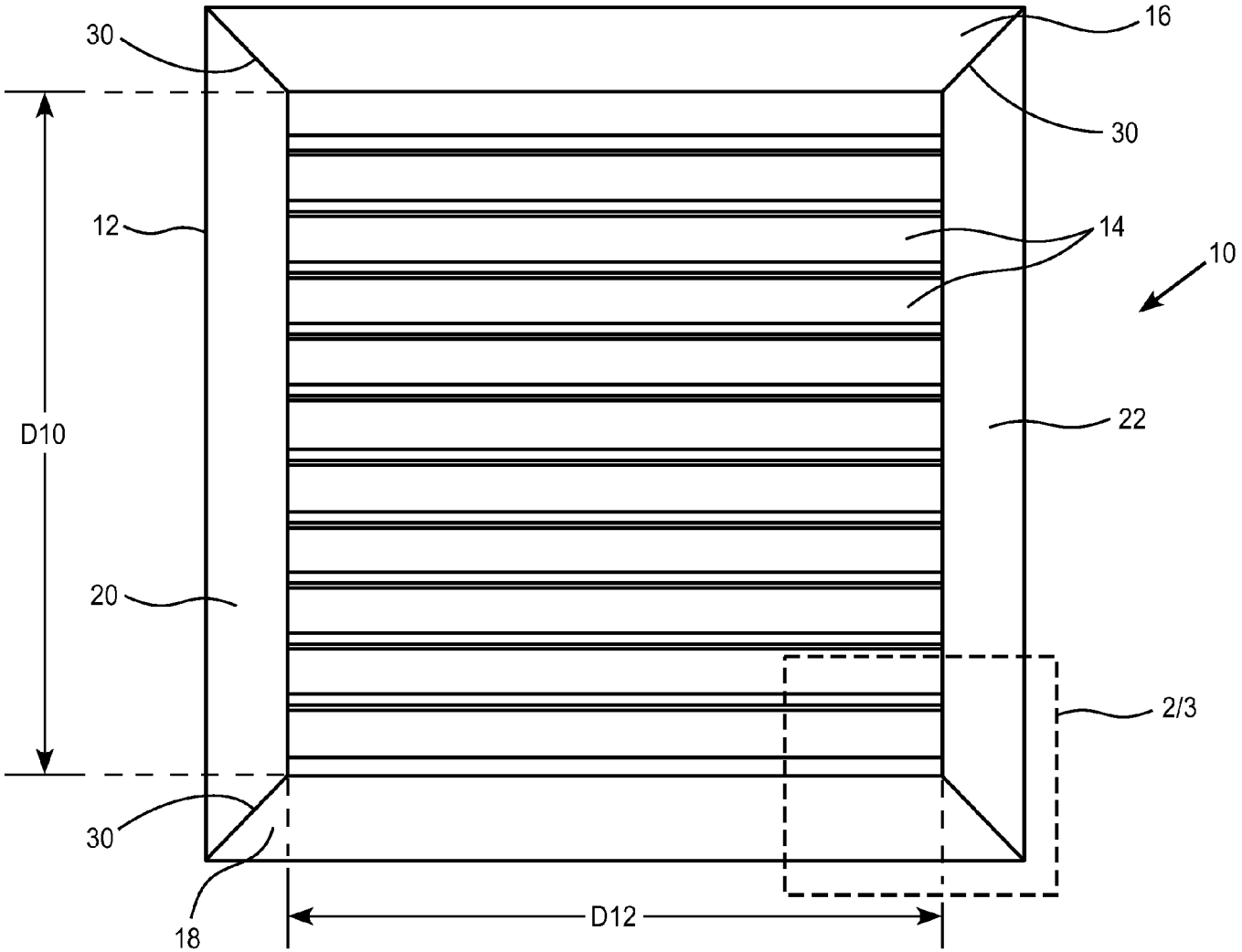
FIG. 1 is a front projection view of a first example shutter, showing the unitary perimeter frame supporting a plurality of louvers.

The described structures are referenced as "shutters," but the term is only for purposes of identifying their general function, and does not limit the described structures to being mounted to a building using a hinge mechanism.

Objectives of the described shutters include durable, easy-to-manufacture, economical and selectively aesthetic protection of windows and other building portals against forces including those exerted by hurricanes, as well as other forces, both natural and man-made.

A first example of the described shutters includes a unitary perimeter frame, preferably formed of four longitudinal rail members and four corner supporting members, interlocked and bonded into an integrated, unitary structure. The unitary perimeter frame supports a portal protective structure such as, for example, a plurality of louvers or slats.

In the first example, each of the four corner connection members includes a pair of rail engagement members. Each of the longitudinal rail members includes at each of its distal ends a corner support receiving structure, an example being a channel or receptacle, for receiving one of the pair of rail engagement members. The pair of rail engagement structures of each corner connection member, and the receiving structures formed in the longitudinal rails, are constructed and arranged such that each corner connection member secures and supports two longitudinal rail members to form two adjacent sides of, for example, a rectangle, with the corner connection member located at the vertex. The rail engagement structures of the corner connection member project into, and are preferably adhered to the receiving structures of the longitudinal rail members, thereby forming a unitary frame.

An example portal covering for this first example shutter is a plurality of slats, or louvers, supported by the unitary perimeter frame. It will be understood that the term "louver," as used herein, encompasses all of its ordinary and customary meanings in the construction and home building arts, as well as any slat, or plurality of slats, or other structure supportable by the peripheral frame to extend across a window or other portal. The louvers can have any cross section, including, but not limited to, rectangular, oval, circular, and square, and can be either solid or hollow.

In one example arrangement the louvers are supported to lie parallel to one another, substantially within a common plane. In this example, each of the louvers has a first distal end and a second distal end, and extends a length between the two ends substantially equal to the spacing between two opposite facing longitudinal rails. The first distal end is supported by one of the two opposite facing longitudinal rail members, and the second distal end is supported by the other of the two opposite facing longitudinal rail members.

Particular structures and methods for the unitary perimeter frame to support the plurality of louvers are described.

Another example structure includes a center louver-support member.

Another example of the described shutters has a latch guide structure included in the perimeter frame, a slidable latch member supported by the latch guide structure, and a receiving structure secured to an external window frame structure adjacent to the perimeter frame.

DETAILED DESCRIPTION

Figure 2:
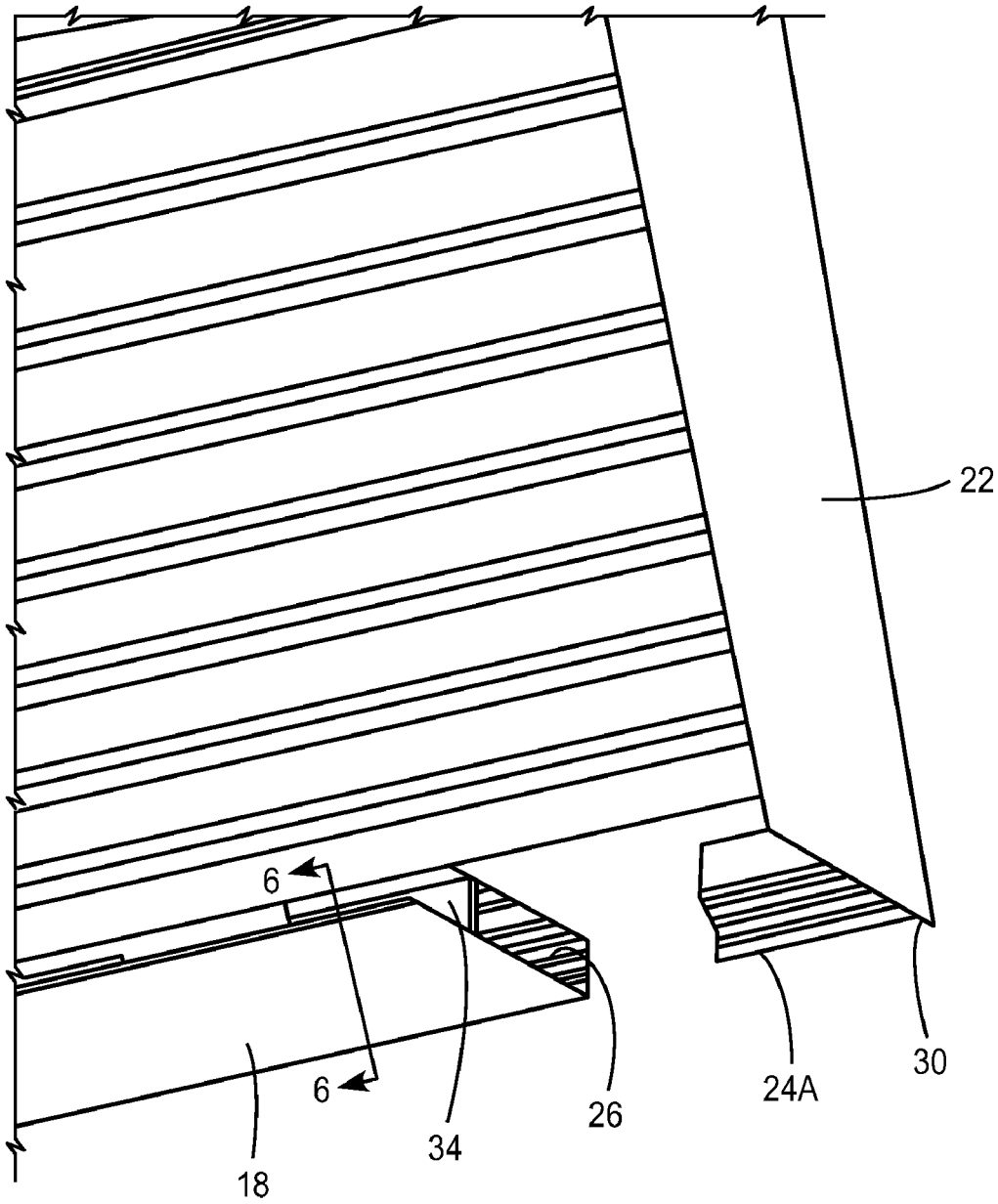
FIG. 2 is a perspective partial cut-away view of the FIG. 1 example shutter.
Figure 3:
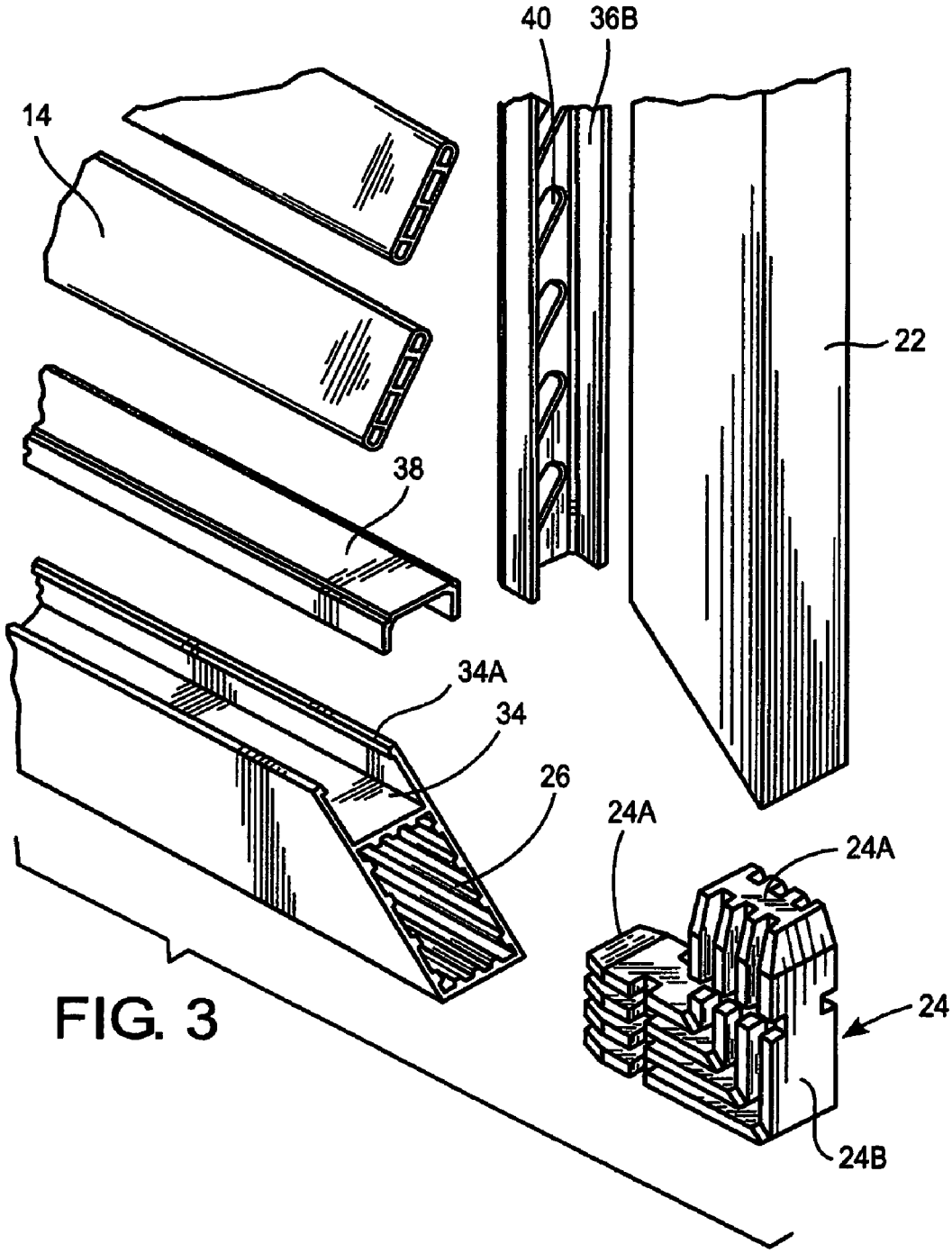
FIG. 3 is an exploded view of an enlargement of the region 3 of FIG. 1.

FIG. 1 is a front projection view of a first example shutter, labeled generally as 10, formed of unitary perimeter frame 12 supporting a plurality of louvers 14. FIG. 2 is a perspective view of the FIG. 1 example shutter 10, having a portion of the unitary perimeter frame 12 partially cut-away to show inner structure, as described further below. FIG. 3 is an exploded view of region 3 of FIG. 1, further depicting the structure of unitary frame 12, as well as its example structure for supporting louvers 14.

Referring to FIGS. 1 and 2, unitary perimeter frame 12 is a permanently bonded unit formed of four perimeter rail members, 16, 18, 20 and 22, and four corner connection members. The four corner connection members are labeled generically as 24, and one of these is visible in the FIG. 2 cut-away view and the FIG. 3 exploded view. In the depicted example, the four perimeter rail members comprise upper perimeter rail member 16, lower perimeter rail member 18, left perimeter rail member 20, and right perimeter rail member 22. It will be understood that the terms "upper," "lower," "left" and "right" are not absolutes and are used only for purposes of having a reference direction within the figures. More particularly, it will be understood that shutter 10 can be constructed such that the extending direction of the louvers 14 is parallel to, or vertical to the ground plane of the building (not shown in FIG. 1) onto which shutter 10 is attached. Further, as will be described in greater detail below, a shutter in accordance with item 10 can be constructed with a hinge, for a pivoting attachment to a building, having a pivot axis along any of the four peripheral rail members 16, 18, 20 and 22.

The preferable material for the perimeter rail members 16, 18, 20 and 22 is a lightweight, strong, workable material such as, for example, T6 aluminum alloy. The corner connection members 24 are preferably formed of a high strength, non-brittle, lightweight, and readily drillable material to which adhesives such as, for example, urethane can securely bond. An example is nylon.

It will be understood that the example shutter 10 is described as having its four peripheral rail members 16, 18, 20 and 22 cut from the same extruded stock, and therefore each having the same cross-section. Likewise, for the present example shutter 10, all four of the corner connection members 24 are identical to one another. Therefore, for this example, the cooperative structure, and configuration by which each of the corner connection members 24 joins distal ends of two of the perimeter rails at the four vertices of the shutter 10, unless otherwise stated, can be understood from the description below in reference to lower right region 3 of FIG. 1.

Figure 4:
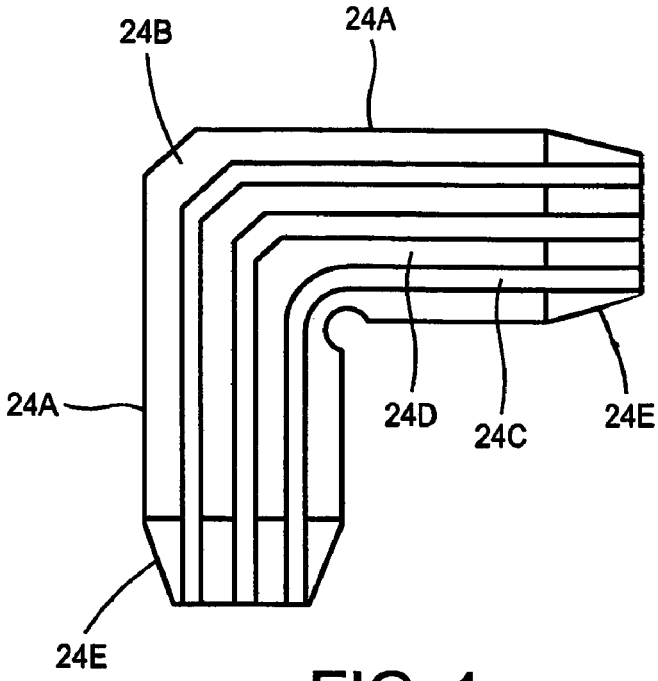
FIG. 4 is a top projection view of the example corner connection member shown in FIG. 3.
Figure 5:
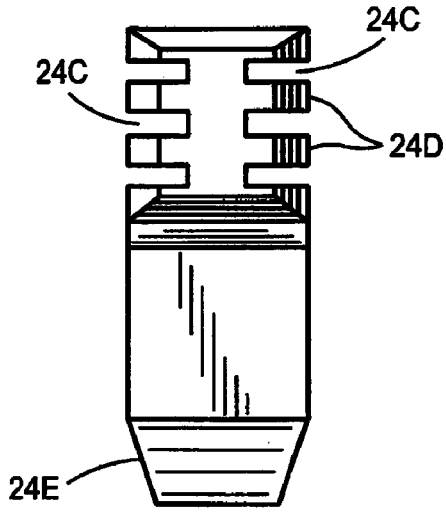
FIG. 5 shows a cross-section of the FIG. 3 and FIG. 4 example rail engagement members, taken along section line 5-5 of FIG. 4.

FIG. 4 is a top projection view of the example corner connection member 24, showing it as an L-shaped structure having two rail engagement members 24A extending approximately 90 degrees in relation to one another, from a common juncture 24B. FIG. 5 shows an end view of the FIGS. 3 and 4 example rail engagement members 24A. Referring to FIGS. 4 and 5, each rail engagement member 24A has a plurality of longitudinal grooves 24C, separated by plurality of lands 24D. The grooves and lands are shown in the depicted example for reasons described further below, but may be omitted if desired. A taper 24E at the distal ends of the rail engagement members 24A is preferred, for ease of insertion into the channels 26 at time of assembly.

Each of the four peripheral rail members 16, 18, 20 and 22 has, at each of its opposing distal ends a channel, each being in accordance with channel 26 visible at the right distal end of lower perimeter rail member 18 in FIGS. 2 and 3. The channels, referenced generically as 26, each extend inward from the distal end of the perimeter rail member a length sufficient to receive a rail engagement member 24A. In the depicted example, perimeter rails 16, 18, 20, and 22 are extruded and, therefore, the channels 26 are actually respective end portions of a channel that extends the entire length of the rail.

Figure 6:
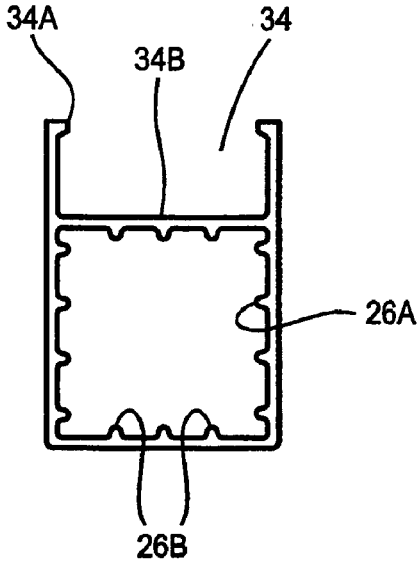
FIG. 6 shows an example cross-section of the perimeter rails of the FIG. 1 unitary perimeter frame, taken along section line 6-6 of FIG. 2.

FIG. 6 shows an example cross-section of the perimeter rails 16, 18,20 and 22, taken along section line 6-6 of FIG. 2, depicting an example channel 26 that receives rail engagement members 24A. Referring to FIGS. 5 and 6 together, it is seen that the cross-section of channel 26 is configured to accommodate the rail engagement member 24A. More particularly, referring to FIG. 6, the example channel 26 has a plurality of first ridges 26A on its side inner surfaces and a plurality of second ridges 268 on its upper and lower inner surfaces. The first ridges 26A contact corresponding lands 240 on two opposite parallel sides of rail engagement member 24A, and the second ridges 268 contact corresponding lands 240 on the other opposite parallel sides of 24A. The spacing between adjacent first ridges 26A, and the spacing between adjacent second ridges 268, is such that these align with the lands 240 on the rail engagement members 24A.

With continuing reference to FIG. 5, the first ridges 26A on the two side opposing and the second ridges 268 on the upper and lower surfaces are spaced with respect to the outer dimensions of the rail engagement members 24A, preferably to form a reasonable, for example, slight interference fit, when these structures are inserted into the channels 26. A slight interference fit may be preferable, as any clearance between the channel 26 and the rail engagement member 24A may allow flexing of unitary perimeter frame 12 that, over time, may decrease the operational life of the shutter. The degree of interference fit, if any, between the ridges 26A and 26B, and the lands 24D of the rail engagement member 24A, is based on the desired insertion force at time of manufacture. This in turn is based, in part, on the dimensions of the actual product, and the material of which the corner connection member is formed. This is readily identified, upon reading this description, by persons of ordinary skill in the industrial arts pertaining to shutter manufacture.

The ridges 26A and 26B on the channel 26, and the grooves 24C and lands 24D are not essential for the structures contemplated in accordance with this description. As will be further understood from the example assembly process described below, grooves and lands such as structures 24C and 24D formed in the rail engagement members 24A may better facilitate the insertion, application and distribution of adhesives. Similarly, ridges 26A and 26B are contemplated as allowing a slight interference fit between the ridges 26B and the rail engagement member 24A, or the lands 24D, without incurring binding or requiring excessive force for assembly.

Referring to the FIG. 1 example, as further depicted by FIG. 2, the distal ends of each of the perimeter rail members have a mitered surface 30, each being, for example, 45 degrees with respect to the longitudinal axis of the rail member. The 45-degree mitering provides for the peripheral rail members to completely, or at least substantially cover the inner connection members 24 after the assembly into the unitary perimeter frame 12 of FIG. 1.

Referring to FIGS. 3 and 6, upper perimeter rail member 16 has a cross-section defining channel 26 and a guide channel 34. The depicted guide channel is U-shaped having a pair of opposing abutment ridges 34A on lateral parallel walls extending away from a bottom surface 34B. The left and right perimeter rails members 20 and 22, since they have the same cross-section as rail 16, have the same U-shaped guide channel as 34 of the upper rail 16. A primary purpose of the guide channel 34 is to secure the louver supporting rails 36A and 36B, described below, to the left and right rails 20 and 22. The upper and lower perimeter rails 16 and 18, for this example, do not require a louver-supporting structure. However, in the depicted example, all of the perimeter rail members 14, 16, 18 and 20 have the same cross-section. As described above, this allows all of the perimeter rail members to be cut from the same extruded stock. A result, though, is that guide channel 34 is formed in all of the perimeter rails, not just 18 and 20 that support the louvers 14. The guide channel 34 formed in the upper and lower perimeter rails 16 and 18 can be covered, though, by cosmetic cover rails 38A and 38B, as described in greater detail below.

Figure 7:
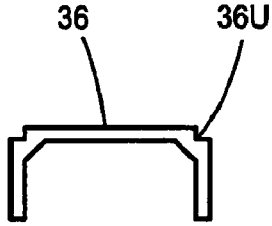
FIG. 7 shows a cross-section of example louver-support rails supported by the perimeter rails according to FIG. 6.

FIG. 7 shows a cross-section of example louver-support rails 36A and 36B, labeled generically as 36. For this example, since the upper and lower perimeter rails 16 and 18 have the same channel 34 as the left and right perimeter rails 20 and 22, the optional cosmetic cover rails 38 have the same cross section as that depicted in FIG. 7.

Referring to FIGS. 6 and 7, it is seen that the guide channel 34 has a cross-section such that the cross-section of louver support rails 36A and 36B can be inserted at the distal ends of the channel 34, but which constrains the inserted rails 36A and 36B from substantial movement in the plane normal to the extending direction of channel 34. Louver support rails 36A and 36B can therefore be inserted into the channels 34 of the left and right perimeter rails 20 and 22, respectively, during the assembly process, as described below. After assembly, upper and lower perimeter rails 16 and 18 constrain the louver support rails 36A and 36B from movement in the vertical direction, where "vertical" is, in relation to FIG. 1, the direction by which upper and lower perimeter rails 16 and 18 are spaced apart. Referring to FIG. 7, the depicted example louver supports 36A and 36B include a pair of flats 36U that conform to the abutment ridge 34A of the guide channel 34. Although not essential, this option provides additional support for the louver support rails 36A and 36B within the guide channels 34.

With continuing reference to FIG. 1, louver support rails 36A and 36B have a length preferably slightly less than the height D10 defined by the facing inner surfaces of the upper and lower perimeter rails 16 and 18. The length is preferably sufficiently close to D10 to allow assembly while providing adequate securing of the louver support rails against up and down motion.

Referring to FIG. 3, each louver-support rail 36A and 38B has a plurality of louver-support slots 40, each dimensioned to accommodate and support one end of one of the louvers 14.

Figure 8:
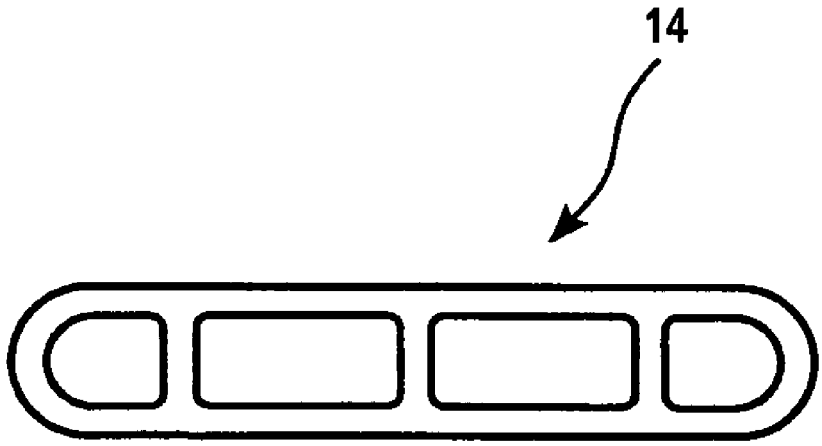
FIG. 8 is a cross-sectional view of an example louver.

FIG. 8 is a cross-sectional view of an example louver 14. The relative fit, and kind of securing, if any, between louvers 14 and louver support slots 40 is a design choice. For example, a clearance fit between louver support slots 40 and louvers 14 is contemplated. A clearance fit provides for ready assembly, as described below. Referring to FIGS. 3 and 8, an example clearance fit is achieved by forming slot 40 with the cross-sectional shape as that of louver 14, but approximately 0.01 inches larger. A clearance fit is only a design choice, and securing louvers 14 to the louver support slots 40 by, for example, welding or adhesive is optional.

Referring to FIGS. 1 and 3, the depicted example shutter 10 has louver-support slots 40 spaced from one another, and angled, to support louvers 14 in the conventional Bahama shutter style. The specific spacing, and angle, is a design choice, except for the general partial constraint that there must be enough louvers 14, spaced adequately close to one another, so that the shutter provides the desired protection. Further, a general preference is that the spacing and the angle of the louvers 14 are such that some visibility is maintained even when the shutter is closed or otherwise positioned to cover its associated window or portal.

Referring to FIGS. 2, 3 6, and 7 the optional cosmetic cover rails 38 will be described. As described above, the optional cosmetic cover rails 38, for this example, have the same cross-section as the left and right louver support rails 36A and 36B, which is shown in FIG. 7. The cross section of cosmetic cover rails 38 is the same as the cross section of louver support rails 36A and 36B because, for this example, the upper and lower perimeter rail members 16 and 18 have the same guide channel 34 as the left and right perimeter rail members 20 and 22, but are not required to support the louver support rails. Therefore, similar to the above-described cooperative structure of the louver support rails 36A and 36B in relation to guide channels 34 of the left and right perimeter rails 20 and 22, cosmetic cover rails 38 fit within the guide channel 34 of the upper and lower rails 16 and 18. The cosmetic cover rails are inserted into these guide channels 34 during assembly, as shown by the example assembly process described below. After assembly, the cosmetic cover rails 38 are secured along three axes, in two by their respective guide channels, and in the other by the left and right perimeter rails 20 and 22. Referring to the FIG. 1 example, cosmetic rail covers 38 have a length that is preferably slightly less width D12 defined by the facing inner surfaces of the left and right perimeter rails 20 and 22.

It will be understood that forming perimeter rails 16, 18, 20 and 22 from the same extruded stock is an example, and not a limitation, on the available structures for the unitary perimeter frame 10 in accordance with the present description. For example, one contemplated alternative is to form each of the perimeter rails 16, 18, 22 and 24 from a solid material, such as nylon, and then drill a round channel similar to the depicted channel 26 into each distal end. The drilled and, hence, round channel could be used without further forming by, for example, using L-shaped corner connection members similar to the depicted items 24, but having members corresponding to the first and second supporting inserts 24*a* and 24*b* with a round, instead of square cross-section. A further alternative would be to swage the drilled channels into a square or rectangular shape, in accordance with the FIG. 6 depicted cross-section for the channels 26.

Another variation is to form the perimeter rails that support louvers, such as rails 20 and 22 of the depicted example, with a cross-section different than rails not directly supporting louvers, such as rails 16 and 18 of the depicted example. Further to such contemplated alternate structures, the cross-section of rails not directly supporting louvers, such as rails 16 and 18 of the depicted example, may be formed to render cosmetic cover rails such as 38 unnecessary.

An example assembly process will now be described. The example process is described as a sequence of manual steps, instead of the automated manufacturing that would likely be used. The sequence of steps is not limiting of the sequences contemplated and, instead, is for purposes of understanding the example structure. The description is according to manual steps so as to provide a ready understanding of the novel features of the present shutter. Automated manufacture, and variations in the ordering of the described steps, in whole or in part, is readily implemented by persons of skill in the relevant industrial arts upon reading this description. The example process uses a common extrusion stock for each of perimeter rails 16, 18, 20 and 22, and a common extrusion stock for louver support rails 38A and 38B and cosmetic cover rails 38.

Referring to FIGS. 1 and 2, an example upper perimeter rail 16, and lower perimeter rail 18, a left perimeter rail 20 and a right perimeter rail 22 are each cut from an extrusion of, for example, aluminum having the FIG. 6 example cross section. The number of louvers 14 is a design choice, with the depicted number being only for purpose of example. Accordingly, two louver support rails 36A and 36B are cut, and a plurality of slots 40 are stamped, or otherwise formed, with each slot having a length and width providing approximately 0.01" clearance relative to the thickness and width of the louvers 14. Each of the louvers 14 is cut to a length slightly less than D12 described above. Therefore, such that, when the assembly is complete, one end inserts into a slot 40 in the louver support rail 36A held by the channel 34 of the left perimeter rail 20, and its other end inserts into a slot 40 of the louver support rail 36B in the slot 34 of the right perimeter rail member 22. Cosmetic cover rails 38 are cut from the same extrusion stock as the louver support rails 36A and 36B. Four corner connection members 24 are molded from nylon, each formed generally in accordance with the above-described examples.

Next, a urethane adhesive is applied to one rail engagement member 24A of a first of the four corner connection members 24, and then inserted into the channel at one end of the left perimeter rail 20. Left louver support rail 36A, with a plurality of slots 40 as described above, is then inserted into the U-shaped guide channel 34 of the left perimeter rail 20. Adhesive is then applied to the rail engagement member 24A of a second of the four corner connection members 24, and the insert 24*a* is then inserted into the other end of the left rail 20. Next, adhesive is applied to the protruding rail engagement member 24A of the first corner connection member 24 secured in the channel 26 at the upper end of the left perimeter rail 20. Likewise, adhesive is applied to the other rail engagement member 24A of the second corner connection member 24 secured in the channel 26 at the lower end of the rail 20. The channel 26 at the left end of the upper perimeter rail 16 is then slid onto that rail extension member 24A at the upper end of the left rail 20. The upper perimeter rail 16 is slid over protruding rail extension member 24A of the corner connection member 24 at the upper end of the rail 20 until the mitered ends of rails 20 and 16 meet. The first corner connection member 24 thereby secures the upper end of the left perimeter 20 rail to the left end of the upper perimeter rail 16, as shown by FIG. 1.

The channel 26 at the left end of the lower perimeter rail 18 is then slid onto the adhesive-covered protruding rail extension member 24A at the lower end of the left perimeter rail 20. The lower perimeter rail 18 is slid over the second supporting insert of the corner connection member at the lower end of the rail 20 until the mitered ends of rails 20 and 18 meet. The second corner connection member 24 thereby secures the lower end of the left perimeter rail 20 to the left end of the lower perimeter rail 18, as shown by FIG. 1. A partial assembly is now formed, consisting of the left perimeter rail 20, with louver support rail 36A substantially secured in its guide channel 34, the upper perimeter rail 16 and the lower perimeter rail 18.

Next, one cosmetic cover 38 is inserted into channel 34 of the upper perimeter rail 16, and the other cosmetic cover rail 38 is inserted into the channel 34 of the lower perimeter rail 18. Each of the cover rails is inserted until its distal end abuts the left perimeter rail member 20. A urethane adhesive is then applied to one rail engagement member 24A of a third of the four corner connection members 24, which is then inserted into the channel 26 at the upper end of the right perimeter rail 22. Louver support rail 36B, also with slots 40 as described above, is then inserted into the U-shaped guide channel 34 of the right perimeter rail 22. Adhesive is applied to rail engagement member 24A of the fourth corner connection member 24, which is then inserted into the other end of the right perimeter rail 22.

The right perimeter rail 22, with louver support rail 36B in its guide channel 34, can now be attached to the intermediate assembly of the left, upper and lower perimeter rails 20, 16 and 18, to form the unitary frame 10, and securing the nine louvers 14, as shown by FIG. 1. First, adhesive is applied to the protruding other rail engagement member 24A of the third corner connection member 24 secured in the channel 26 at upper end of the right perimeter rail 22. Likewise, adhesive is applied to the protruding other rail engagement member 24A of the fourth corner connection member 24 secured in the channel 26 at the lower end of the rail 22. Next the louvers 14 are inserted into the slots 40 of the louver support rail 36A secured to the left perimeter rail 20, and held in a planar, parallel alignment as shown by FIGS. 1 and 2. The alignment may be assisted by use of an assembly fixture, such fixtures being readily constructed by persons of ordinary skill in the pertinent industrial arts. Next, the protruding rail engagement member 24A of the third corner connection member 24, and the protruding rail engagement member 24A of the fourth connection member 24 are inserted, respectively, into the left channel 26 of the upper perimeter rail 16 and the lower perimeter rail 18, respectively. The right perimeter rail 22 is then urged toward the left perimeter rail 20, with the louvers 14 aligned with the slots 40 of the right rail's louver support rail 36B. The urging is continued until the mitered upper end of the right perimeter rail 22 contacts the mitered left end of the upper perimeter rail 16, and mitered lower end of rail 22 contacts the mitered left end of rail 18. The assembly is then complete, with the louvers 14 held at each end by the louver support rails 36A and 36B secured by the left perimeter rail 20 and right perimeter rail 22, respectively.

After the adhesive sets the assembly above is a unitary perimeter frame 12 as shown by FIG. 1.

Figure 9:
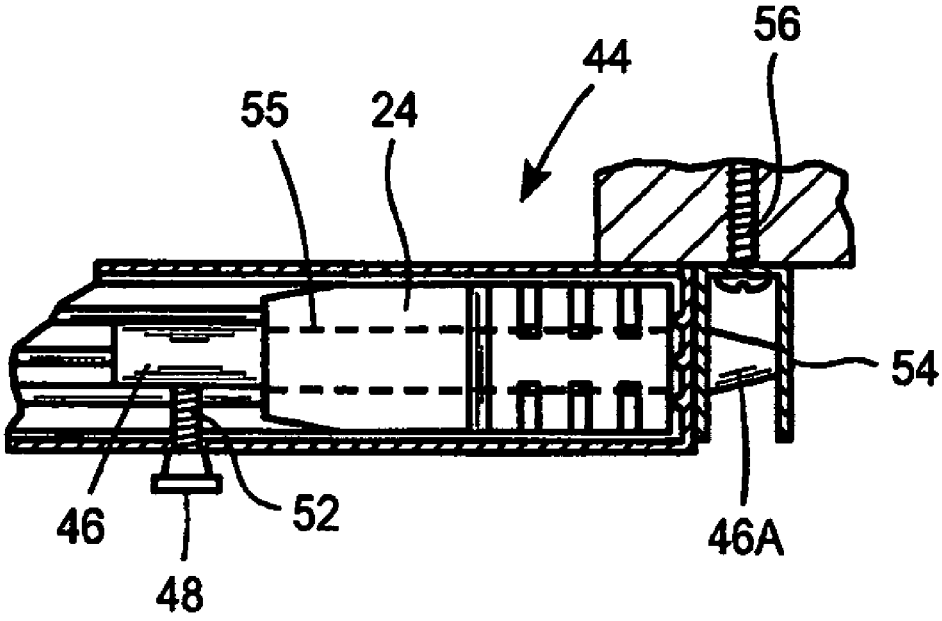
FIG. 9 is a cut-away front view of a latch mechanism that utilizes one of the corner connection members as a latch supporting guide.

FIG. 9 is a cut-away front view of a latch mechanism 44 that utilizes one of the corner connection members 24 as a latch-supporting guide. The FIG. 9 example shows the latch mechanism 44 at the lower right of the FIG. 1 example, which is the junction of the lower perimeter rail 18 and the right perimeter rail 22. This is not limiting, as the FIG. 9 latch can be formed at any one or more corners of the frame 12, utilizing any of the corner connection members 24.

Referring to FIG. 9, the latch mechanism 44 comprises a latch pin 46, a thumbscrew 48 having a threaded shaft 52, and a latch pin receiver 54. The latch pin 46 passes through a clearance hole 55 formed in the corner connection member 24. The clearance hole 55 may be drilled through a standard-form corner connection member 24 or, for example, only certain of the corner connection members maybe molded having the hole 55. A slot having a width slightly larger than the diameter of the threaded shaft 52 of the thumbscrew 48 is formed through the bottom wall of the perimeter rail 18, having a length allowing the latch pin 46 to extend into the latch pin receiver 54, for locking the shutter, while allowing the latch pin 46 to be retracted from the latch pin receiver 54, to release the shutter.

Figure 10:
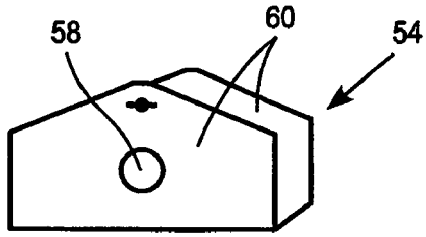
FIG. 10 is a perspective view of an example latch pin receiver for receiving the latch pin of the FIG. 9 example.

FIG. 10 is a perspective view of an example latch pin receiver 54, formed as a camel bracket having a through hole 58 in one of its two side plates 60. The through hole 58 is slightly larger than the latch pin 46, to provide clearance but not so large as to promote excessive movement normal to the pin axis. Referring again to FIG. 9, the latch pin 46 has a tapered end 46A, which allows the pin 46 to seek the through hole 58 when actuated into a locking position, as described below. The latch pin receiver 54 is mounted using, for example, two screws 56 to, for example, an exterior of a building adjacent to a window.

Figure 11:
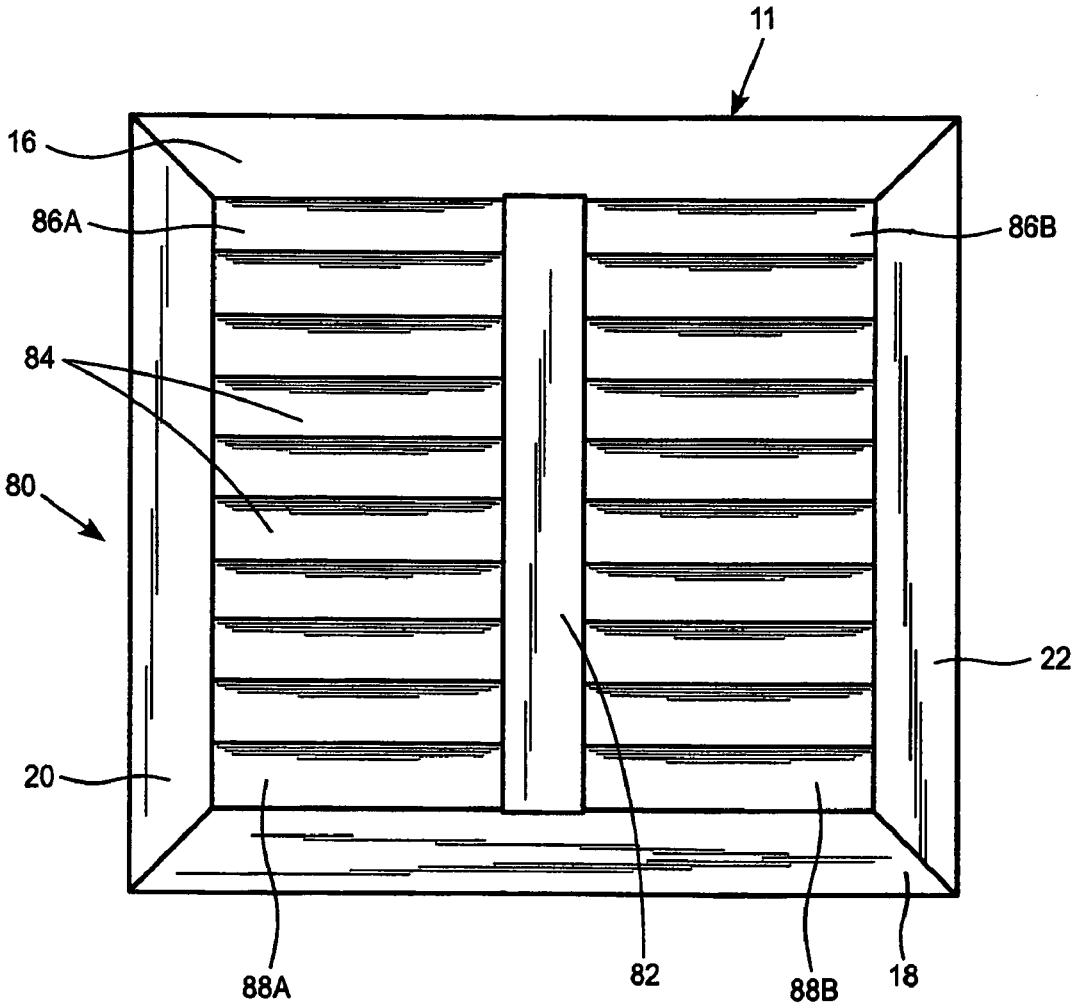
FIG. 11 is a front projection of another described shutter, having a center support member.

FIGS. 11 to 16 show a further shutter 11 employing a unitary perimeter frame such as described in reference to FIG. 1, further including a center support for the louvers. Referring to FIG. 11, which is a front projection of the shutter 11, the depicted shutter comprises a unitary frame 80, a center louver-support member 82, a plurality of one-piece louvers 84, a top two-piece louver, with its parts labeled 86A and 86B, and a bottom two-piece louver, with its parts labeled louver 88A and 88B. The unitary frame 80 is, for this example, substantially identical to the FIG. 1 unitary frame 12 of shutter 10 and, accordingly, like members will be numbered in the same manner as FIGS. 1-8.

Figure 12:
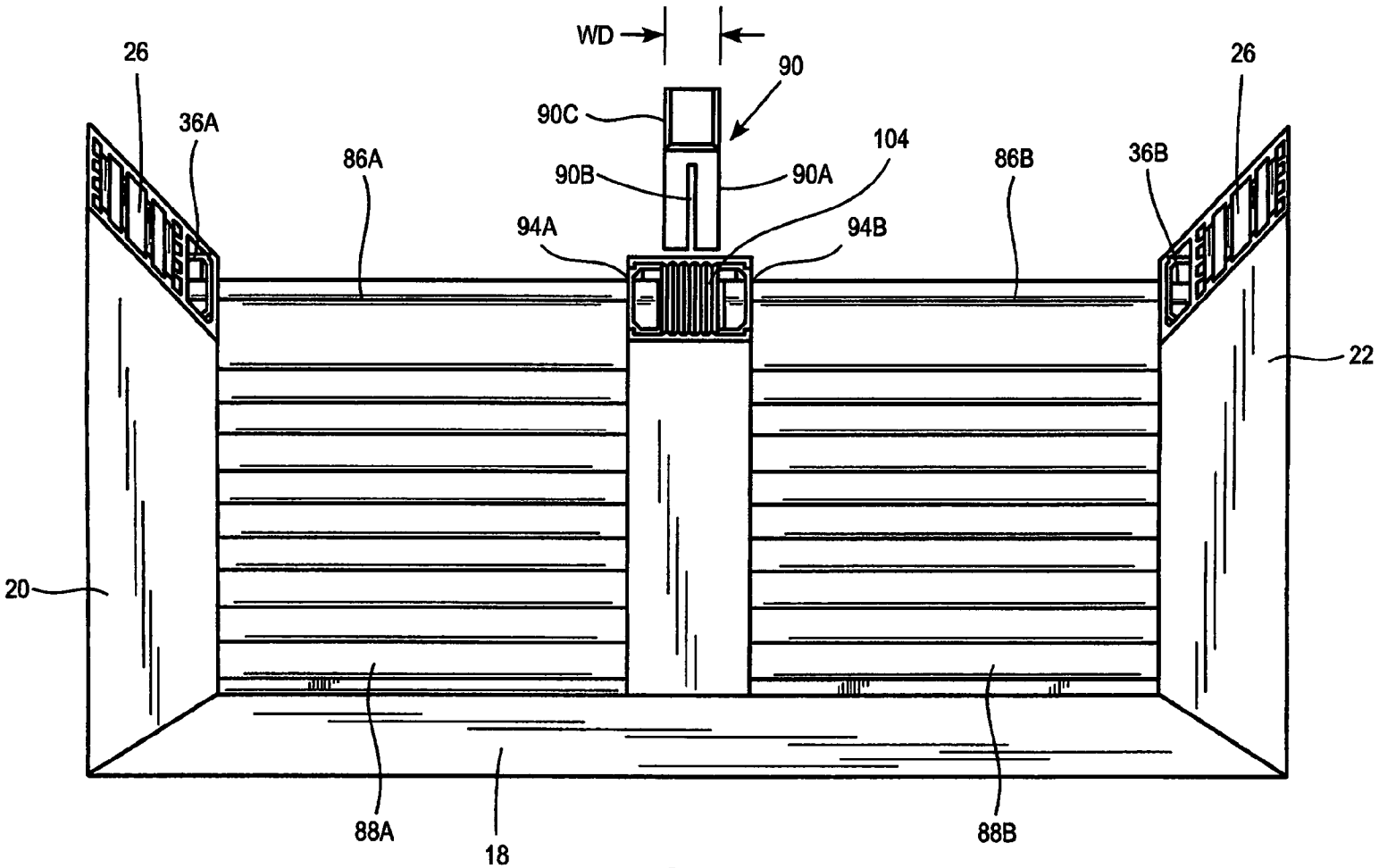
FIG. 12 shows the FIG. 11 shutter with its upper perimeter rail removed, and a center lateral securing member suspended above its insertion position.
Figure 13:
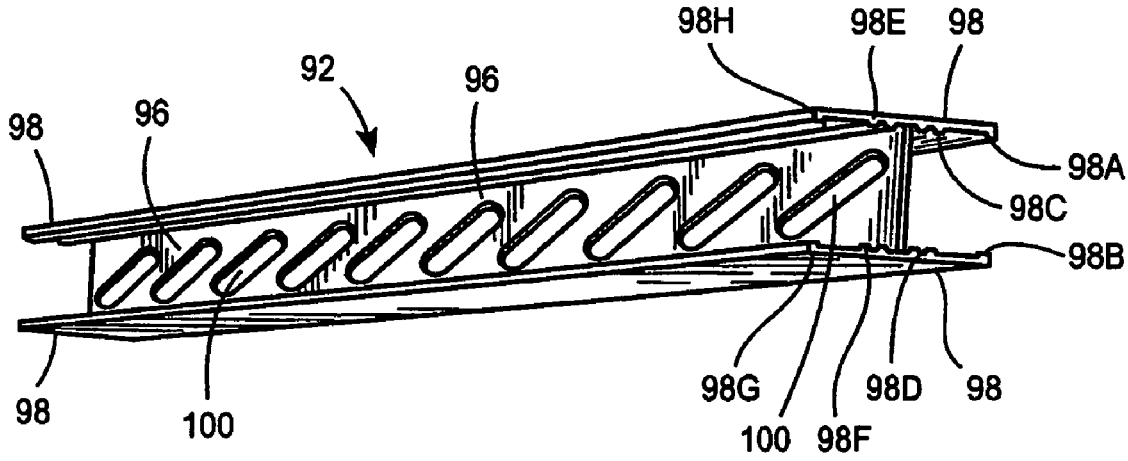
FIG. 13 shows a perspective view of the I-frame of the center louver-support member of the FIG. 11 shutter.
Figure 14:
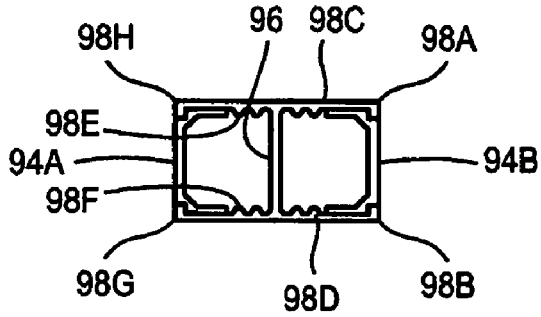
FIG. 14 shows the end view of the FIG. 13 I-frame, having left center louver support rail and right center louver support rail inserted.

FIG. 12 shows the FIG. 11 shutter with its upper perimeter rail 16 removed, and center lateral securing member 90 suspended above its insertion position, which is described further below. FIG. 13 shows a perspective view of the I-frame 92 of the center louver-support member 82, and FIG. 14 shows the end view of the I-frame 92, having left center louver support rail 94A and right center louver support rail 94B inserted. Referring to FIG. 14, the I-frame 92 has a center wall 96 and four flanges 98. Ridges 98A, 98B, 98C, 98D, 98E, 98F, 98G and 98H extend the length of the I-frame 92. Ridges 98A, 98B, 98C, 98D are constructed and arranged to constrain the left center louver-support rail 94A from substantial movement normal to the extending direction of member 82. Likewise, ridges 98E, 98F, 98G and 98H are constructed and arranged to constrain the right center louver-support rail 94B from substantial movement normal to the extending direction of member 82.

For this example, the left and right center louver support rails 94A and 94B are structured identical, respectively, to the left and right louver support rails 36A and 36B. As described above, the left and right louver support rails 36A and 36B are inserted into and constrained by the guide channel 34 formed on the left and right perimeter rails 20 and 22, respectively. Accordingly, using FIG. 7 as an example cross-section for the left and right louver support rails 36A and 36B, the left and right center louver support rails 94A and 94B each have the FIG. 7 cross-section. Therefore, ridges 98A, 98B, 98C and 98D, and ridges 98E, 98F, 98G and 98H each define a channel (not labeled) substantively identical to the guide channel 34 formed on the outer perimeter rail members 16, 18, 20 and 22.

Referring to FIG. 13, the center wall 96 of the I-frame 92 has a plurality of clearance holes 100 shaped in accordance with the cross-section of the one-piece louvers 84. Since the frame 80 is in accordance with the frame 10 of FIG. 1, the clearance holes 100 are identically shaped, spaced and angled as the clearance holes 40 formed in the left and right louver-support rails 36A and 36B. Likewise, each of the left and right center louver-support rails 94A and 94B has a plurality of clearance holes 100, identically shaped, spaced and angled as the clearance holes 40 formed in the left and right louver-support rails 36A and 36B.

FIG. 15 shows the shutter 80 of FIG. 11 with its upper perimeter rail 16 suspended above its assembly position, showing the tongs 90A that insert into the space 104 visible in FIG. 12. Slot 90B provides clearance for the center wall 94 of the I-frame 92. FIG. 16 is a partial cut-away of the top perimeter rail member, in its assembled position reflected in FIG. 11, showing the upper portion 90C of the center lateral support member 90 inserted into the channel 34 of the upper perimeter rail 16.

Referring to FIG. 16, instead of a one-piece cosmetic cover rail 38 as described in reference to FIGS. 1, two lateral support rails are inserted into the channel guide 34 of the upper perimeter rail 16, the left labeled as 106A, the right labeled as 106B. For this example, the lateral support rails 106A and 106B have the same cross section as rails 36A, 36B and 38, thereby utilizing the fact that perimeter rails 16, 18, 20 and 22, for this example, have the same cross section and, hence, the guide same channel 34.

With continuing reference to FIG. 16, the left distal end of left lateral support rail 106A abuts against the upper left of the left perimeter frame member 16. Likewise the right distal end of right lateral support rail 106B abuts against the upper left of the right perimeter frame member 16.

A structure identical to the example described in reference to FIG. 16 is formed at the lower end of the center louver-support member 82, with another center lateral support member 90 having a portion 90C between another pair of lateral support rails 106A and 106B within the channel 34 of the lower perimeter rail 18.

Referring to FIG. 12, it is seen that the outer distal end of the left upper louver 86A extends through the upper hole 40 in the left louver support rail 36A, and abuts against the bottom 34A of channel 34 formed on the left perimeter rail 16. The inner distal end of the left upper louver 86A extends through the upper hole 100 in the left center louver support rail 94A, but does not extend all the way to the center wall 96. Similarly, the outer distal end of the right upper louver 86B extends through the upper hole 40 in the right louver support rail 36B, and abuts against the bottom 34A of channel 34 formed on the right perimeter rail 18. The inner distal end of the right upper louver 86B extends through the upper hole 100 in the right center louver support rail 94B but, like the inner distal end of louver 86A, does not extend all the way to the center wall 96. The spacing between the inner distal ends of the upper left louver 86A and upper right louver 86B, with their respective outer distal ends against the left and right perimeter rails 20 and 22, is slightly larger than the width WD of the center support member 90. When the upper perimeter rail 16 is installed as shown in FIGS. 11 and 16, the channel 90B allows the tongs 90A to extend along center wall 96 of the I-frame 92. The tongs 90A, and the left and right perimeter rails 20 and 22, thereby support the left and right upper louvers 84A and 84B from substantial lateral movement.

The lower left louver 88A and lower right louver 88B are supported by a center support member identical to item 90, in the manner described above for the upper left and right louvers 86A and 86B.

Referring to FIGS. 11-16, each of the louvers 84 is a one-piece structure, having its left distal end extending through a corresponding hole 40 in the left louver support rail 36A, its center region extending through aligned respective holes in the left center louver support rail 94A, the center wall 96 of the I-frame 92, and the right center louver support rail 94B, and its right distal end extending through a corresponding hole 40 in the right louver support rail 36B.

The described structure provides for all, or for most of the louvers to be one-piece, and to be further supported in the center by member 82. The unitary perimeter frame 80 has the same construction as the unitary perimeter frame 12 of FIG. 1, comprising perimeter rails 16, 18, 20 and 22, assembled into a unitary structure by four corner members 24, as described above. The unitary perimeter frame 80 supports a plurality of one-piece louvers 84, a top two-piece louver, with its parts labeled 86A and 86B, and a bottom two-piece louver, with its parts labeled louver 88A and 88B. This increases the strength of the louvers 84 with respect to airborne objects. The above-described center louver-support member 82, formed of the I-frame 92 and center louver-support rails 94A and 94B, is only for purposes of example. Various alternative structures, however, are contemplated. One alternative is to form all of the louvers as one-piece, such as items 84. This may be done, for example, by using a lateral securing member similar to item 90 but, instead of having tongs 90A, having a structure that can insert into the space corresponding to space 104 that would remain if louvers 86A and 96B were formed as one piece and extended through the center wall 96.

Shutters in accordance with the above-described structures provide superior protection and durability, relative to prior art shutters having perimeter frames screwed or welded together. For example, the rail engagement members 24A extend into the channels 26 a distance of, for example, approximately two to three inches, and are preferably secured therein with adhesives, which distributes the torque and flexing forces at the frame joints over a much larger area than obtained with welded or screwed abutments. Further, by using corner connection members 24 of, for example, nylon, the corner connection members can flex when the shutter is subjected to severe wind and flying object forces, which reduces the bending and twisting forces applied to the abutting ends of the perimeter rail members, as compared to prior art welds and screw connection. Still further, the connections provided by the cooperative fit of the corner connection members 24 and the channels 26 of the perimeter rail members 16, 18, 20 and 22 avoid heat effects, and associated weakening, often resulting from welding methods of the prior art.

Figure 17:
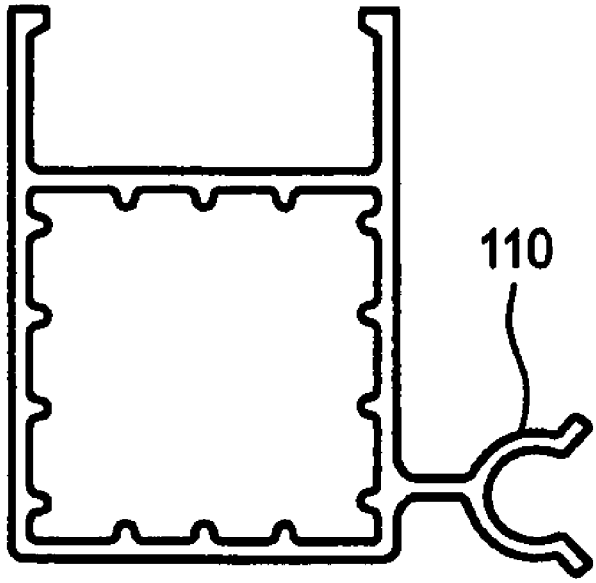
FIG. 17 is an example perimeter rail including a hinge structure.
Figure 18:
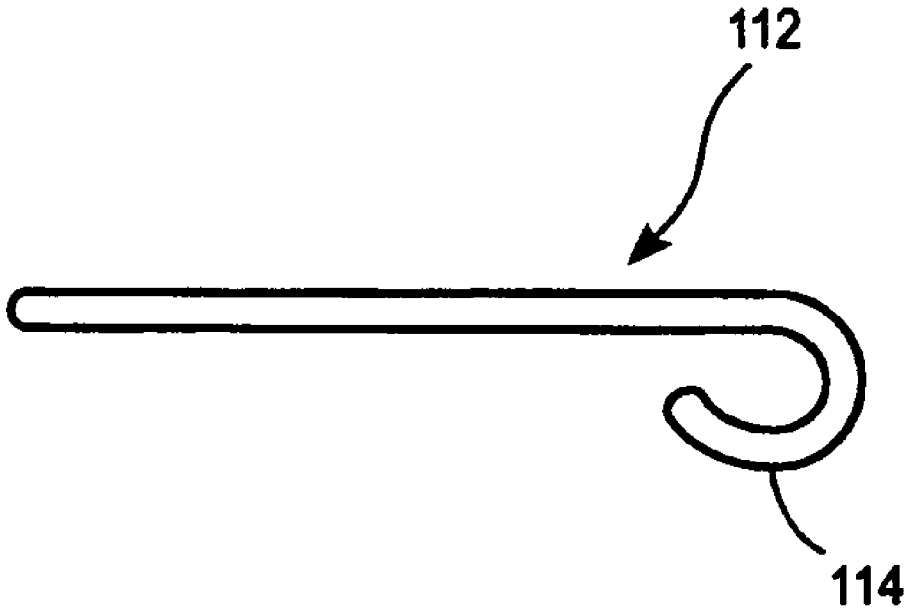
FIG. 18 shows another example hinge structure for attachment to one of the perimeter rails.

The above-described shutters can be installed onto buildings using any known attachment method, including a conventional hinge arrangement. FIG. 17 shows an adaptation of a conventional hinge to the above-described extruded perimeter rail members, having a hinge member 110. The hinge member 110 may be extruded to extend the entire length of perimeter rail members. Another example hinge in shown by FIG. 18, which is a plate 112 having a hinge member 114 similar to 110, with the plate 112 being screwed or otherwise attached to a perimeter rail.

Those skilled in the arts pertaining to the above-described shutter structures and methods understand that the preferred embodiments described above may be modified, without departing from the true scope and spirit of the description and claims, and that the particular embodiments shown in the drawings and described within this specification are for purposes of example and should not be construed to limit the claims below.

What is claimed is:

1. A shutter for protection of building portals against forces exerted by hurricanes, comprising:

a unitary frame including:

four longitudinal rail members, each longitudinal rail member having a pair of opposite distal ends, said four longitudinal rail members are arranged such that one of said four longitudinal rail members is disposed along each side of a rectangular perimeter, such that one distal end of one of said longitudinal rail members substantially abuts one distal end of another of said four longitudinal rail members at a respective vertex of said rectangular perimeter, each longitudinal rail member having a receptacle opening at each of its distal ends and a receptacle extending more than a first distance toward its opposite distal end; and four corner connection members, each located at a respective one of the four vertices of said rectangular perimeter, and each corner connection member having a first projection and a second projection, said first projection extending said first distance into and bonded to a surface of the receptacle of one of said longitudinal rail members and said second projection extending said first distance into and bonded to a surface of the receptacle of an adjacent longitudinal rail member;

wherein at least one of said four corner connection members has a latch-pin passage extending through its first projection in its extending direction, said one of said longitudinal rail members comprises an elongated clearance passage from an exterior of said one of said longitudinal rail members to a channel, extending in the direction of said channel, and said adjacent longitudinal rail member comprises a latch pin clearance hole, and further comprising a latch pin extending through and supported by said latch-pin passage;

wherein said four corner connection members flex for reducing bending and twisting forces applied to said unitary frame; and a portal covering structure secured to and supported by said unitary frame.

2. The shutter according to claim 1 wherein the channel extends between a first distal end and a second distal end of at least one of said four longitudinal rail members, wherein a first length of said channel forms the receptacle at said first distal end of the at least one of said four longitudinal rail members and a second length of said channel forms the receptacle at the second distal end of said at least one of said four longitudinal rail members.

3. The shutter according to claim 1, wherein a first of said longitudinal rail members includes a first longitudinal rail member retaining structure for retaining a first secondary rail member adjacent and parallel to said first longitudinal rail member, and a second of said longitudinal rail members includes a second longitudinal rail member retaining structure for retaining a second secondary rail member adjacent and parallel to said second longitudinal rail member, said first of said longitudinal rail members and said second of said longitudinal rail members forming facing sides of said unitary frame.

4. The shutter according to claim 3, further comprising the first secondary rail member constrained adjacent and parallel to said first of said longitudinal rail members by said first longitudinal rail member retaining structure, and the second secondary rail member constrained adjacent and parallel to said second of said longitudinal rail members by said second longitudinal rail member retaining structure, and wherein each of said first secondary rail member and said second secondary rail member includes at least one louver-support through hole, and wherein said portal covering structure comprises at least one louver supported at one end by said louver-support through hole formed in said first secondary rail member and supported at its other end by said louver-support through hole formed in said second secondary rail member.

5. The shutter according to claim 4, wherein a third of said longitudinal rail members includes a retaining structure for retaining a pair of third secondary rail members adjacent and parallel to said third longitudinal rail member, and colinear with respect to one another, and a fourth of said longitudinal rail members includes a retaining structure for retaining a pair of fourth secondary rail members adjacent and parallel to said fourth longitudinal rail member, and colinear with respect to one another, said third longitudinal rail member and said fourth longitudinal rail member forming facing sides of said unitary frame perpendicular to said first and second longitudinal rail members.

6. The shutter according to claim 4, further comprising a center louver support rail having at least one louver-support through hole, secured to said unitary frame to extend substantially perpendicular to said at least one louver, and wherein said at least one louver passes through said at least one louver-support through hole in the center louver support rail, such that said at least one louver is supported at a location of said at least one louver between a first distal end of said at least one louver and a second distal end of said at least one louver.

7. The shutter according to claim 5, further comprising a center louver support rail having at least one louver-support through hole, secured to said unitary frame to extend substantially perpendicular to said at least one louver, and wherein said at least one louver passes through and is supported by said at least one louver-support through hole in the center louver support rail, such that said at least one louver is supported at a location of said at least one louver between a first distal end of said at least one louver and a second distal end of said at least one louver, and wherein a first distal end of said center louver support rail abuts said third longitudinal rail member and a second distal end of said center louver support rail, opposite said first distal end, abuts said fourth longitudinal rail member, and said center louver support rail is supported from movement in a direction parallel to said louver by said pair of third secondary rail members and said pair of fourth secondary rail members.

8. The shutter according to claim 7, further comprising a first abutment member engaged with and extending from the first distal end of said center louver support rail, and a second abutment member engaged with and extending from the first distal end of said center louver support rail, wherein said center louver support rail is supported, at its first distal end, from movement in a direction parallel to said louver by a first of said pair of third secondary rail members abutting said fourth longitudinal rail member at one end and said first abutment member at its other end, and by a second of said pair of third secondary rail members abutting said second longitudinal rail member at one end and said first abutment member at its other end, and wherein said center louver support rail is supported, at its second distal end, from movement in a direction parallel to said louver by a first of said pair of fourth secondary rail members abutting said fourth longitudinal rail member at one end and said second abutment member at its other end, and by a second of said pair of fourth secondary rail members abutting said second longitudinal rail member at one end and said second abutment member at its other end.

9. The shutter according to claim 1 further comprising:

a latch pin receiving structure, having a latch pin receptacle, mounted to an exterior wall surface; and a manually rotatable screw having a threaded shaft extending through said elongated clearance passage and threadably engaged with said latch pin, with a manual contact structure exterior to said adjacent longitudinal rail member, wherein tightening said manually rotatable screw substantially prevents motion of said latch pin in the extending direction of said latch pin passage, and wherein loosening said manually rotatable screw allows movement of said latch pin from an extended position in which it extends though said latch pin passage, through said latch pin clearance hole and into said latch pin receptacle, to a retracted position wherein the latch pin does not extend into said latch pin receptacle.

10. The shutter according to claim 1 wherein each of the distal ends of said four longitudinal rail members has a substantially 45 degree mitered surface, and wherein at least one of said four corner connection members and said receptacles of at least two of said four longitudinal rail members are constructed and arranged such that when said mitered surface at one distal end of one of said at least two longitudinal rail members abuts said mitered surface at one distal end of another of said at least two longitudinal rail members, the first projection of said at least one of said four corner connection members extends said first distance into the receptacle at said one distal end of said one of said at least two longitudinal rail members, and the second projection of said at least one of said four corner connection members extends said first distance into the receptacle at said one distal end of said another of said longitudinal rail members.

11. The shutter according to claim 4, wherein the retaining structure of said first longitudinal rail member is a U-shaped channel, extending the length of said first longitudinal rail member, formed of an exterior wall of said first longitudinal rail member and a pair of lateral walls extending parallel to one another, in a direction away from the exterior wall, with a first ridge extending along the distal edge of a first of said pair of lateral walls, and a second ridge extending along the distal edge of a second of said pair of lateral walls, the distance between opposing faces of said pair of lateral walls being greater than a width of said first secondary rail member, and the distance between said first ridge and said second ridge being less than said width of said first secondary rail member.

12. The shutter according to claim 11, wherein all of said four longitudinal rail members have the same cross-section.

13. The shutter according to claim 11, wherein all of said four longitudinal rail members first have the same outer cross-sectional dimensions.

14. The shutter according to claim 1 wherein at least one of said four corner connection members has its first projection extending substantially perpendicular to its second projection.

15. The shutter according to claim 14 wherein at least one of said four corner connection members is an L-shaped structure, with said first projection and said second projection extending substantially perpendicular from a common junction member to form an L shape.

16. The shutter of claim 1, wherein the latch pin passes through a latch pin receiver mounted exterior to said shutter, wherein the latch pin receiver comprises a camel bracket with two side plates and a through hole in one of the two side plates for receiving an end of the latch pin.

17. The shutter of claim 1, wherein said four corner connection members comprise a plurality of longitudinal grooves separated by a plurality of lands on at least one surface of at least one of said four corner connection members, wherein the plurality of lands corresponds to a plurality of grooves within a corresponding one of said longitudinal rail members.

18. A shutter for protection of building portals against forces exerted by hurricanes comprising:

a first outer frame member extending between a first distal end and a second distal end, and having a first receptacle at said first distal end and a second receptacle at said second distal end;

a first frame corner connection member, having a first projection secured within said first receptacle of said first outer frame member, and having a second projection;

a second frame corner connection member, having a first projection secured within said second receptacle of said first outer frame member, and having a second projection;

a second outer frame member extending between a first distal end and a second distal end, having a first receptacle at said first distal end receiving and secured around said second projection of said first frame corner connection member, and having a second receptacle at said second distal end;

a third outer frame member extending between a first distal end and a second distal end, having a first receptacle at said first distal end receiving and secured around said second projection of said second frame corner connection member, and having a second receptacle at said second distal end;

a third frame corner connection member, having a first projection secured within said second receptacle of said second outer frame member, and having a second projection;

a fourth frame corner connection member, having a first projection secured within said second receptacle of said third outer frame member, and having a second projection;

a fourth outer frame member extending between a first distal end and a second distal end, having a first receptacle at said first distal end receiving and secured around said second projection of said third frame corner connection member, and having a second receptacle at said second distal end receiving and secured around said second projection of said fourth frame corner connection member;

wherein at least one of said first, second, third and fourth corner connection members has a latch-pin passage extending through its first projection in its extending direction, a corresponding one of said first, second, third and fourth corner connection members further comprises an elongated clearance passage from an exterior of said corresponding outer frame member extending in an extending direction of the corresponding outer frame member, and another one of said first, second, third and fourth corner connection members includes a latch pin clearance hole, and further comprising a latch pin extending through and supported by said latch-pin passage;

wherein the latch pin passes through a latch pin receiver mounted exterior to a frame comprising the first, second, third and fourth outer frame members, wherein the latch pin receiver comprises a camel bracket with two side plates and a through hole in one of the two side plates for receiving an end of the latch pin; and wherein said first, second, third and fourth corner connection members flex for reducing bending and twisting forces applied to said shutter.

19. The shutter according to claim 18, wherein said first outer frame member includes a plurality of first louver-support receptacles spaced apart from one another along said first axis, said fourth outer frame member includes a plurality of second louver-support receptacles facing and in alignment with said plurality of first louver-support receptacles, and a portal-covering structure comprising a plurality of louver members, each louver member having a first distal end projecting into and supported by a corresponding one of said first louver support receptacles and a second distal end opposite its first distal end projecting into and supported by a corresponding one of said second louver support receptacles.

20. The shutter according to claim 18 wherein at least said first frame corner connection member has its first projection extending substantially perpendicular to its second projection.

21. The shutter according to claim 20 wherein at least said first frame corner connection member is an L-shaped structure, with said first projection and said second projection extending substantially perpendicular from a common junction member to form an L shape.

22. The shutter of claim 18, wherein at least one of said first second, third and fourth corner connection members comprises a plurality of longitudinal grooves separated by a plurality of lands on at least one surface of at least one of said first, second, third and fourth corner connection members, wherein the plurality of lands corresponds to a plurality of grooves within the first, second, third and fourth outer frame members.

23. A shutter for protection of building portals against forces exerted by hurricanes, comprising:

a rectangular frame structure having a first pair of perimeter rails parallel to and spaced apart from one another, and a second pair of perimeter rails parallel to and spaced apart from one another and perpendicular to the first pair of perimeter rails, said first pair of perimeter rails secured to said second pair of perimeter rails, wherein each of the first pair of perimeter rails includes a plurality of louver support receptacles arranged such that the plurality of louver support receptacles included in one of the first pair of perimeter rails faces and is aligned with the plurality of louver support receptacles included in the other of the first pair of perimeter rails;

a center louver support rail extending parallel to the first pair of perimeter rails, having one of its distal ends secured to a first of said second pair of perimeter rails, and the other of its distal ends secured to the other of said second pair of perimeter rails, wherein said center louver support rail includes a plurality of louver support through holes;

a plurality of louvers, each of said plurality of louvers having a first of its distal ends extending into and supported by a corresponding one of said plurality of louver support receptacles formed in said one of said first pair of perimeter rails, the other of its distal ends extending into and supported by a corresponding one of said plurality of louver support receptacles formed in the other of said first pair of perimeter rails, and extending through a corresponding one of said plurality of louver support through holes formed in said center louver support rail; and wherein each of said plurality of louvers is supported by the center louver support rail but is not welded to the center louver support rail for increasing the strength of said plurality of louvers with respect to airborne objects.

24. The shutter of claim 23, further comprising:

four frame corner connection members having a first projection secured within a receptacle of one of said first pair of perimeter rails, and having a second projection secured within a receptacle of one of said second pair of perimeter rails, wherein the four frame corner connection members have a plurality of lands separated by a plurality of grooves complementary to a plurality of lands and a plurality of grooves within the first pair of perimeter rails and the second pair of perimeter rails;

wherein at least one of the said four frame corner connection members has a latch-pin passage extending through the first projection in its extending direction, a corresponding one of said pairs of perimeter rails further comprises an elongated clearance passage from an exterior of said corresponding one of said pairs of perimeter rails extending in an extending direction of the corresponding one of said pairs of perimeter rails, and a second one of said pairs of perimeter rails includes a latch pin clearance hole, and further comprising a latch pin extending through and supported by said latch-pin passage.

25. The shutter of claim 24, wherein said four frame corner connection members flex for reducing bending and twisting forces applied to said rectangular frame.

26. The shutter of claim 24, wherein the latch pin is adapted to pass through a latch pin receiver mounted exterior to said rectangular frame, wherein the latch pin receiver comprises a camel bracket with two side plates and a through hole in one of the two side plates for receiving an end of the latch pin.

27. The shutter of claim 24, wherein at least one of said four frame corner connection members comprise a plurality of longitudinal grooves separated by a plurality of lands on at least one surface of at least one of said corner connection member, wherein the plurality of lands corresponds to a plurality of grooves within said first pair of perimeter rails and said second pair of perimeter rails.

28. A shutter for protection of building portals against forces exerted by hurricanes, comprising:

a rectangular frame structure having a first pair of perimeter rails parallel to and spaced apart from one another, and a second pair of perimeter rails parallel to and spaced apart from one another and perpendicular to the first pair of perimeter rails, said first pair of perimeter rails secured to said second pair of perimeter rails with L-shaped corner connection members, wherein the L-shaped corner connection members comprise a plurality of longitudinal grooves separated by a plurality of lands on at least one surface of the L-shaped corner connection member, wherein the plurality of lands corresponds to a plurality of grooves within the first pair of perimeter rails and the second pair of perimeter rails;

wherein the L-shaped corner connection members flex for reducing bending and twisting forces applied to said rectangular frame;

wherein at least one of said first pair of perimeter rails includes a latch pin guide extending in the direction of said at least one of said first pair of perimeter rails and at least one of said second pair of perimeter rails includes a latch pin clearance hole aligned with said latch pin guide; and a latch pin supported by and movable within said latch pin guide, in said direction between an extended position and a retracted position, wherein, in said extended position a distal portion of latch pin extends through said latch pin clearance hole to protrude outward from said rectangular frame.

29. The shutter of claim 28, wherein said at least one of said first pair of perimeter rails including said latch pin guide comprises a hollow member surrounding and supporting said latch pin guide, and wherein said latch pin guide includes a latch pin support through hole dimensioned and arranged to accommodate and support said latch pin in moving between said extended and retracted position.

30. The shutter of claim 29, wherein an elongated slot extends in a depth direction from an outer surface of said hollow member of said at least one of said first pair of perimeter rails having said latch pin guide into said latch pin support through hole, and has a slot length extending in the direction that said latch pin moves from said extended position to said retracted position comprises a hollow member, and has a slot width, further comprising:

a manual actuator member connected to said latch pin and extending outward, in a direction radial with respect to the direction that said latch pin moves from said extended position to said retracted position, through said slot, and having a manual contact surface above said slot.

31. The shutter of claim 28, wherein the latch pin is adapted to pass through a latch pin receiver mounted exterior to said rectangular frame, wherein the latch pin receiver comprises a camel bracket with two side plates and a through hole in one of the two side plates for receiving an end of the latch pin.

32. A shutter for protection of building portals against forces exerted by hurricanes, comprising:

a rectangular frame structure having a first pair of perimeter rails parallel to and spaced apart from one another, and a second pair of perimeter rails parallel to and spaced apart from one another and perpendicular to the first pair of perimeter rails, said first pair of perimeter rails secured to said second pair of perimeter rails, wherein each of the first pair of perimeter rails includes a plurality of louver support receptacles arranged such that the plurality of louver support receptacles included in one of the first pair of perimeter rails faces and is aligned with the plurality of louver support receptacles included in the other of the first pair of perimeter rails;

a center louver support rail extending parallel to the first pair of perimeter rails, having one of its distal ends secured to a first of said second pair of perimeter rails, and the other of its distal ends secured to the other of said second pair of perimeter rails, wherein said center louver support rail includes a plurality of louver support through holes;

a plurality of louvers, each of said plurality of louvers having a first of its distal ends extending into and supported by a corresponding one of said plurality of louver support receptacles formed in said one of said first pair of perimeter rails, the other of its distal ends extending into and supported by a corresponding one of said plurality of louver support receptacles formed in the other of said first pair of perimeter rails, and extending through a corresponding one of said plurality of louver support through holes formed in said center louver support rail;

wherein each of said plurality of louvers is supported by the center louver support rail but is not welded to the center louver support rail for increasing the strength of said plurality of louvers with respect to airborne objects;

four frame corner connection members having a first projection secured within a receptacle of one of said first pair of perimeter rails, and having a second projection secured within a receptacle of one of said second pair of perimeter rails, wherein the four frame corner connection members have a plurality of lands separated by a plurality of grooves complementary to a plurality of lands and a plurality of grooves within the first pair of perimeter rails and the second pair of perimeter rails;

wherein at least one of the said four frame corner connection members has a latch-pin passage extending through the first projection in its extending direction, a corresponding one of said pairs of perimeter rails further comprises an elongated clearance passage from an exterior of said corresponding one of said pairs of perimeter rails extending in an extending direction of the corresponding one of said pairs of perimeter rails, and a second one of said pairs of perimeter rails includes a latch pin clearance hole, and further comprising a latch pin extending through and supported by said latch-pin passage;

a latch pin receiving structure, having a latch pin receptacle, mounted to an exterior wall surface;

a manually rotatable screw having a threaded shaft extending through said elongated clearance passage and threadably engaged with said latch pin, with a manual contact structure exterior to said second pair of perimeter rails;

wherein tightening said manually rotatable screw substantially prevents motion of said latch pin in the extending direction of said latch pin passage, and wherein loosening said manually rotatable screw allows movement of said latch pin from an extended position in which it extends though said latch pin passage, through said latch pin clearance hole and into said latch pin receptacle, to a retracted position wherein the latch pin does not extend into said latch pin receptacle;

wherein said four frame corner connection members flex for reducing bending and twisting forces applied to said shutter; and wherein said center louver support rail is an I-frame comprising a center wall, four flanges, and ridges protruding from at least one interior surface of one of said four flanges and extending the length of said I-frame.

33. The shutter of claim 32, wherein the latch pin passes through a latch pin receiver mounted exterior to said shutter, wherein the latch pin receiver comprises a camel bracket with two side plates and a through hole in one of the two side plates for receiving an end of the latch pin.

* * * * *